US007293392B2

(12) United States Patent
Krumbacher

(10) Patent No.: US 7,293,392 B2
(45) Date of Patent: Nov. 13, 2007

(54) MULTIPLE FLEXIBLE TRACK

(75) Inventor: Andreas Krumbacher, Queensland (AU)

(73) Assignee: Oziflex Pty Ltd., Smithfield, New South Wales (AU)

( * ) Notice: Subject to any disclaimer, the term of this patent is extended or adjusted under 35 U.S.C. 154(b) by 0 days.

(21) Appl. No.: 10/993,445

(22) Filed: Nov. 22, 2004

(65) Prior Publication Data

US 2005/0086896 A1 Apr. 28, 2005

Related U.S. Application Data

(63) Continuation of application No. PCT/AU02/01086, filed on Aug. 8, 2002.

(30) Foreign Application Priority Data

May 20, 2002 (AU) ..... 42358/02

(51) Int. Cl.
*E04B 2/82* (2006.01)

(52) U.S. Cl. ..... 52/241; 52/242; 52/245; 52/246; 52/247; 52/274; 52/293.3; 403/83; 403/84; 403/103; 403/104; 403/110

(58) Field of Classification Search ..... 52/108, 52/241–247, 274, 293.3; 403/84, 86, 103, 403/104, 110, 83
See application file for complete search history.

(56) References Cited

U.S. PATENT DOCUMENTS 3,053,358 A * 9/1962 Gross ..... 52/696
4,894,962 A * 1/1990 Conn ..... 52/86
5,291,717 A * 3/1994 Turner ..... 52/745.07
5,590,493 A * 1/1997 Wilson ..... 52/108
6,000,181 A * 12/1999 Wheeler ..... 52/241
6,237,301 B1 * 5/2001 Paradis ..... 52/717.03
6,612,104 B2 * 9/2003 Blase ..... 59/78.1
6,625,942 B1 * 9/2003 Wheeler ..... 52/241
6,637,173 B1 * 10/2003 Wheeler ..... 52/745.12
6,655,100 B1 * 12/2003 Andino ..... 52/247
7,073,299 B1 * 7/2006 diGirolamo et al. ..... 52/241

FOREIGN PATENT DOCUMENTS

| | | |
|---|---|---|
| AU | 200055052 | 3/2001 |
| EP | 0 453 415 | 10/1991 |
| WO | WO 02/18723 | 3/2002 |

* cited by examiner

*Primary Examiner*—Jeanette Chapman
*Assistant Examiner*—Yvonne M. Horton
(74) *Attorney, Agent, or Firm*—Young & Thompson

(57) ABSTRACT

An elongate flexible track is flexibly positionable from an initial straight configuration to a non-straight configuration having a horizontal, vertical or compound curvature in which it is lockable with locking elements. The track has a plurality of stud receiving components each being formed with a horizontal base wall having a longitudinal edge and a transverse edge, a side wall on a first side of the track and a side wall on a second side of the track, the side walls extending vertically from respective longitudinal edges of the base wall. The base and side walls define a space in which a stud end of an elongate stud can be mounted. Adjacent stud receiving components are joined by linking elements which include pivot elements about which the linking elements are adjustable in one or more directions. At least one locking elements passage is provided on each side of the track.

10 Claims, 5 Drawing Sheets

MULTIPLE FLEXIBLE TRACK

This application is a continuation of PCT/AU02/01086 filed Aug. 8, 2002.

FIELD OF THE INVENTION

This INVENTION relates to a flexible track for use in constructing a building element and in particular, but not limited to, use in the construction of a wall frame.

BACKGROUND OF THE INVENTION

In the field of construction, a conventional approach to wall framing involves the use of materials including a lower track and an upper track, each track generally comprising a length of timber having a U-shaped cross-sectional configuration, the tracks being secured in spaced apart opposed alignment to respective structures, such as a floor and ceiling respectively, and with one or more elongate studs being erected between the lower and upper tracks, the stud(s) being secured with conventional fastening means, such as nails, to the respective tracks at respective opposite stud ends.

There are, however, a number of disadvantages associated with this conventional approach including: difficulties in aligning and maintaining alignment of the studs and tracks during the securing step; that the U-shaped cross-sectional configuration of tracks is not adapted for use in constructing walls having horizontally, vertically or compound curved portion(s) or where the distance between a floor and ceiling varies.

Prior Art document U.S. Pat. No. 6,115,984 addresses one or more of the aforesaid disadvantages of the conventional wall construction approach by providing a track which is flexible. The flexible track consists of a longitudinally extending repeating unit structure, the repeating unit comprising a stud receiving component and a linking means. Respective adjacent stud receiving components are joined end-to-end along a longitudinal track axis by linking means and may be selectively angled and positioned relatively to each other by adjustment of the linking means. The track as a whole is flexible only by means of the adjustability of the distinct linking means. In its initial condition, the track has a rigid/self-holding straight configuration which can be selectively modified, if required, to achieve a predetermined rigid/self-holding non-straight track configuration, including horizontal, vertical or compound curvature(s), by the separate adjustment of relevant linking means. Each stud receiving component of the track has a horizontal base wall having opposed transverse edges and opposed longitudinal edges and a side wall extending vertically from each longitudinal side edge of the base wall. The base and side walls of a stud receiving component define a space in which a stud end can be received and fixedly retained in position by use of conventional fastening means such as screws, nails, bolts or the like which can be inserted through a fixing point in the form of a fixing aperture provided in at least one side wall. Each linking means consists of a membrane joining the base and side walls of adjacent stud receiving components. The membrane includes a base member and opposed side members extending between adjacent base and side walls respectively. The base member and opposed side members are each in the form of a strip which is inwardly bent about a medial fold line. The relative angle and position of adjacent stud receiving components can be adjusted with the use of a tool, such as a set of pliers, by applying a predetermined force to a selected strip so as to appropriately adjust the angle of bend in the strip. Track vertical curvature and horizontal curvature, respectively, are effected by adjusting the bend of the base member strip and one or both side member strips, whereas compound curvature is effected by a combination of these adjustments.

Advantageously, the track disclosed in U.S. Pat. No. 6,115,984 can be of any suitable length, with the stud receiving components and the linking means being integrally formable from a blank of precut folded material. Furthermore, the prior art track provides for the relatively easier alignment of studs with tracks and the formation of wall structures and apertures such as window apertures having an arcuate configuration.

Disadvantageously, however, the prior art track cannot be adjusted to a predetermined rigid/self-holding non-straight configuration simultaneously as a whole because a predetermined force is necessarily applied to each or selected linking means to adjust the relative angle and positioning of adjacent stud receiving components. Accordingly, adjustment of the track configuration as a whole is effected by the separate and progressive adjustment of distinct linking means and consequently is time consuming and difficult. A further disadvantage is that the prior art track linking means has a configuration and/or arrangement that can obstruct the insertion and/or retention of a stud end in a stud receiving component depending on track configuration.

OBJECT OF THE INVENTION

It is therefore an object of the present invention to overcome, or at least substantially ameliorate, one or more of the aforesaid disadvantages and shortcomings of the aforementioned prior art.

OUTLINE OF THE INVENTION

In one aspect therefore the invention relates to a flexible track for use in constructing a building element, said track comprising:

- a plurality of stud receiving components connected end-to-end, each stud receiving component being adapted to receive an end portion of an elongate stud;
- flexible linking means connecting adjacent stud receiving components; and
- locking means;
- said flexible linking means enabling a section of the track comprising multiple components to be manually manipulated as a whole section from a straight configuration to a non-straight configuration;
- wherein said section of the track is lockable in said non-straight configuration by the locking means. The locking means may also be used to lock sections of the track in a straight line.

Preferably:

- said linking means includes pivot means about which said linking means is adjustable;
- adjacent stud receiving components being selectively flexibly angled and positioned relatively to one another by pivotal movement at said linking means about said pivot means;
- said linking means allowing the track to pivot to provide a track configuration not confined to a single plane.

Preferably, the linking means comprises a deformable narrow bridge between adjacent stud receiving components.

Preferably, the linking means further includes perforations on opposite sides of the bridge to enhance the flexibility of the linking means.

Preferably, each said stud receiving component includes a horizontal base wall having opposed transverse edges and opposed longitudinal edges and a side wall extending vertically from each longitudinal side edge of said base wall.

Preferably:

each said linking means joins adjacent transverse edges of the base walls of adjacent stud receiving components;

said linking means defining a gap between respective side walls and between corners of respective base walls of adjacent stud receiving components on opposite sides of said track;

said gap being adapted to widen or narrow to flexibly position the track about said linking means.

Preferably, the linking means comprising a set of four downwardly extending pivot members, said set branching from a medial section of said linking means in symmetrical arrangement about a medial transverse fold line and an imaginary medial longitudinal line to a respective proximal first or second side of the adjacent base wall, there being formed a pair of transversely medial perforations disposed along said imaginary medial longitudinal line in longitudinally offset opposed relation about said medial transverse fold line.

Preferably:

said track includes at least one locking means passage on each of a first and a second side of a longitudinal track axis;

said locking means passage being defined by a plurality of longitudinally spaced apart locking means apertures and a plurality of longitudinally spaced apart fixing points;

there being a separate locking means for each said locking means passage, said locking means being adapted to extend in longitudinal spanning arrangement through the plurality of locking means apertures and be securable to said track at each of said plurality of fixing points to maintain said track in said locked configuration.

Preferably, in one embodiment of the flexible track:

each of said stud receiving components includes a horizontal base wall having opposed transverse edges and opposed longitudinal edges and a side wall extending vertically from each longitudinal side edge of said base wall;

there being a locking means passage on the first side of said longitudinal axis defined by at least one locking means aperture disposed on the side wall on the first side of each said stud receiving component;

there being a locking means passage on the second side of said longitudinal axis defined by at least one locking means aperture disposed on the side wall of the second side of each said stud receiving component;

there being a fixing point at least at an entrance, an exit and a point intermediate said entrance and exit for said locking means along each said locking means passage;

each said locking means comprising a flexible strap;

wherein said flexible straps are adapted to maintain said track in a rigid configuration including a curvature in the horizontal plane when each said flexible strap is fixably secured in said locking means passage at each of said fixing points.

Preferably, in a further embodiment of the flexible track:

each of said stud receiving components includes a horizontal base wall having opposed transverse edges and opposed longitudinal edges and a side wall extending vertically from each longitudinal side edge of said base wall;

there being a pair of locking means passages on the first side of said longitudinal axis, said pair including a lower and an upper locking means passage disposed in relatively parallel vertically spaced apart relation, each of said lower and upper locking means passages being defined by a pair of longitudinally spaced apart locking means apertures disposed on the side wall of the first side of each said stud receiving component;

there being a pair of locking means passages on the second side of said longitudinal axis, said pair including a lower and an upper locking means passage disposed in relatively parallel vertically spaced apart relation, each of said lower and upper locking means passages being defined by a pair of longitudinally spaced apart locking means apertures disposed on the side wall of the second side of each said stud receiving component;

there being a fixing point at least at an entrance, an exit and a point intermediate said entrance and exit for said locking means along each said locking means passage;

each said locking means comprising a wire;

wherein said wires are adapted to maintain said track in a rigid configuration including a curvature in the vertical plane or a compound curvature when each said wire is fixably secured in said locking means passage at each of said fixing points.

Preferably:

said stud receiving components include at least one guideway for said locking means; and said locking means comprises inextensible flexible material being slidable in the or a guideway as the track is manually moved into the non-straight configuration and securable to one or more stud receiving components to lock the track in the non-straight configuration.

Preferably, the stud receiving components include one or more locking means catches adjacent the, a or each guideway, the inextensible flexible material being deformable to engage a selected catch(es) along the track and thereby lock the track in the non-straight configuration.

DETAILED DESCRIPTION OF THE PRIOR ART

Figure 1:
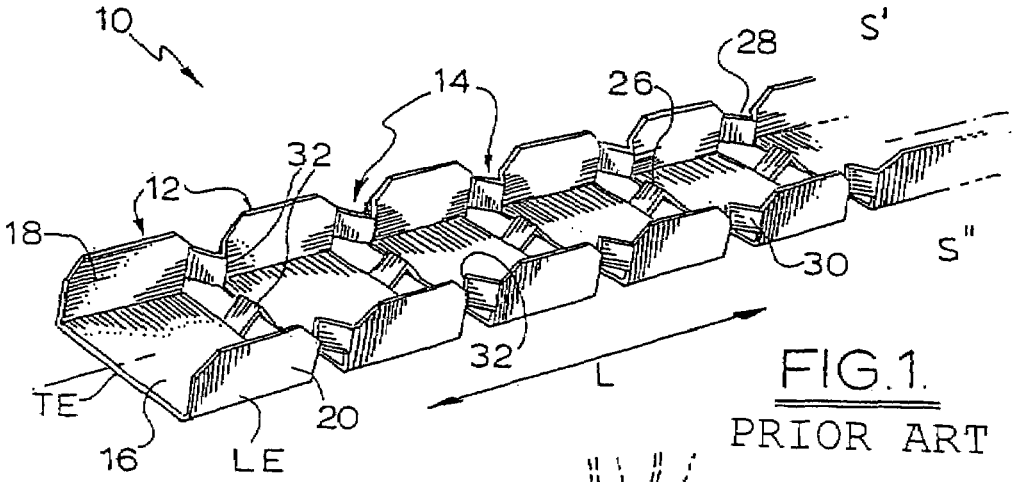
FIG.1. PRIOR ART
FIG. 1 is a partial perspective view of a prior art track in its initial condition having a rigid/self-holding straight configuration.
Figure 2:
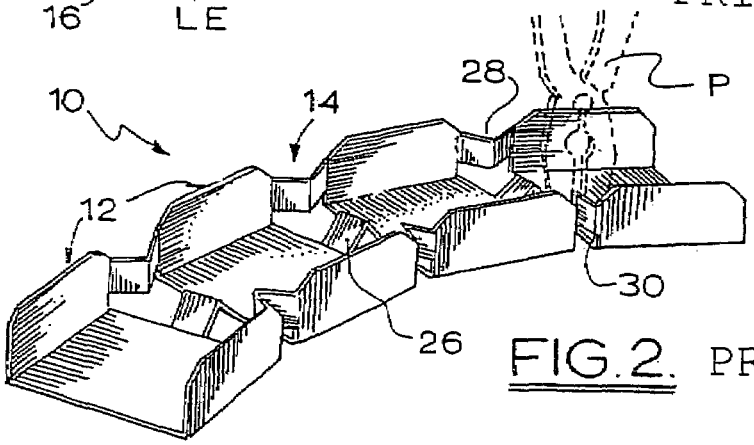
FIG.2. PRIOR ART
FIG. 2 is a partial perspective view of the prior art track shown in FIG. 1 following the separate adjustment of relevant linking means with the use of a tool to achieve a predetermined rigid/self-holding non-straight track configuration
Figure 3:
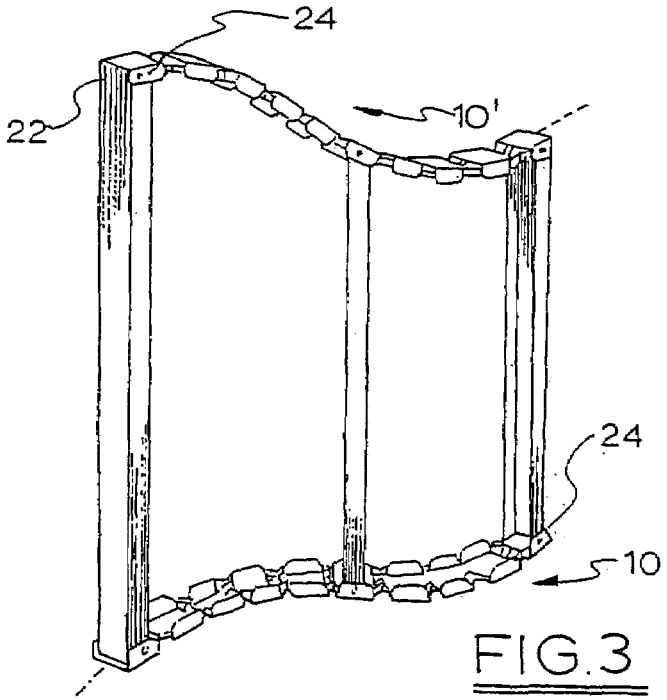
FIG.3 PRIOR ART
FIG. 3 is a partial perspective view of a non-straight wall being formed by a set of studs mounted on a pair of tracks, each track being adjusted from the initial condition shown in FIG. 1 to a predetermined rigid/self-holding non-straight track configuration.

Referring to the drawings, wherein like references are used to designate like features throughout the several views, a prior art flexible track is shown in FIGS. 1 to 3 in accordance with the disclosure of U.S. Pat. No. 6,115,984. The track 10 consists of a plurality of stud receiving components 12 and a plurality of linking means 14 extending end-to-end along a longitudinal track axis L. The track 10 is illustrated in its initial condition in FIG. 1 having a rigid/self-holding straight configuration. Each stud receiving component 12 of the track 10 is shown to consist of a horizontal base wall 16 having opposed longitudinal edges LE and opposed transverse edges TE, a side wall 18 on a first side S' of the track 10 and a side wall 20 on a second side S" of the track, the side walls 18 and 20 extending vertically from respective longitudinal edges LE of the base wall 16. The walls 16, 18 and 20 define a space in which a stud end 22 can be received and fixedly retained in position, as shown in FIG. 3, by the use of conventional fastening means such as screws, nails, bolts or the like (not shown) which are insertable through a fixing aperture 24 provided in a side wall(s) 18 and 20. Each linking means 14 is shown to consist of a membrane joining adjacent stud receiving components 12. Each membrane includes a base member 26 and opposed side members 28 and 30 extending between adjacent base walls 16 and side walls 18 and 20, respectively, of adjacent stud receiving components 12. The base member 26 and opposed side members 28 and 30 are each in the form of a strip which is inwardly bent about a medial fold line 32. The initial condition rigid/self-holding straight configuration of the track 10 can be selectively modified, if necessary, to achieve a predetermined rigid/self-holding non-straight track configuration, such as the horizontal curvature configuration shown in FIG. 2, by the separate adjustment of relevant linking means 14. Respective adjacent stud receiving components 12 are shown selectively angled/positioned relatively to each other by the application of a predetermined force using a tool comprising a set of pliers P to a selected strip 26, 28 and/or 30 so as to appropriately adjust the angle of bend in the strip. The horizontal curvature of the track 10 shown in FIG. 2 is effected by adjusting the bend of side member strip(s) 28 and/or 30, whereas the compound curvature of the upper track 10' shown in FIG. 3 is effected by adjusting the bend side member strip(s) 28 and/or 30 and additionally the base member strips 26. Where a pair of non-straight tracks 10 and 10' are to be jointly used in construction, as shown in FIG. 3, an adjusted first track 10 can be used as a guide in the subsequent adjustment of a second track 10' so that the tracks 10 and 10' have substantially identical configurations. Disadvantageously, however, the track 10 of the prior art cannot be flexibly positioned as a whole from the straight configuration to a predetermined non-straight configuration. Rather, a predetermined force is necessarily applied to each or selected linking means to adjust the relative angle and positioning of adjacent stud receiving components and therefore adjust the track configuration separately and progressively which is time consuming and difficult. Furthermore, insertion and retention of a stud end in a stud receiving component may be obstructed when the relative angle and position of adjacent stud receiving components is adjusted.

DETAILED DESCRIPTION OF THE INVENTION

Referring to FIGS. 4 to 12, wherein like references are used to designate like features throughout the several views and embodiments, there is illustrated a flexible track for use in the construction of building elements including wall frames according to preferred embodiments of the invention. Aside from walls such as internal walls, the invention is suitable for use in the construction of other straight or curved building elements such as partitions, ceilings, arches, declining or inclining floors or ceilings, round columns and certain roofing.

Figure 4:
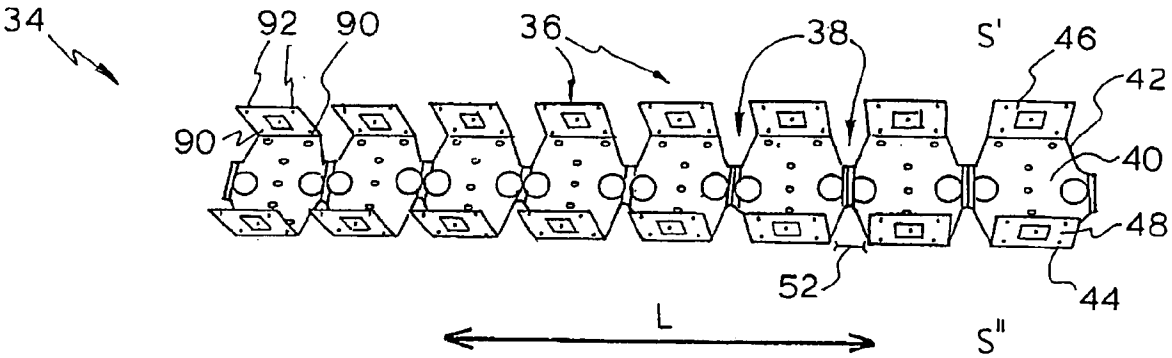
FIG. 4 is a perspective view of a flexible track according to a preferred embodiment of the invention in its initial condition, having a straight configuration.

As illustrated in FIG. 4, the flexible track 34 comprises a plurality of stud receiving components 36, each stud receiving component 36 being adapted to receive an end portion of an elongate stud (for mounting of the stud in a manner similar to FIG. 3 or as otherwise required), and a plurality of linking means 38, each linking means 38 joining an adjacent pair of said plurality of stud receiving components 36 end-to-end along a longitudinal track axis L.

Figure 5:
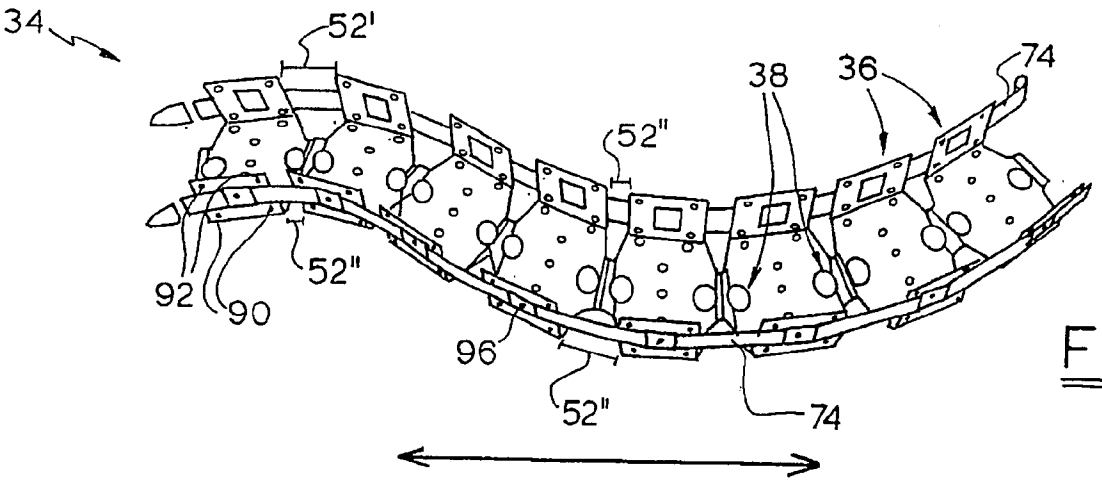
FIG. 5 is a perspective view of a the flexible track shown in FIG. 1 following flexible positioning and locking of the track in a non-straight configuration having a horizontal curvature with preferred locking means comprising flexible straps.
Figure 8:
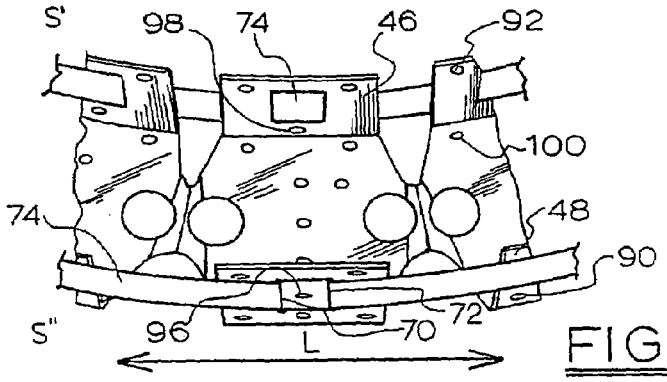
FIG. 8 is an enlarged partial perspective view of the flexible track illustrated in FIG. 5.
Figure 10:
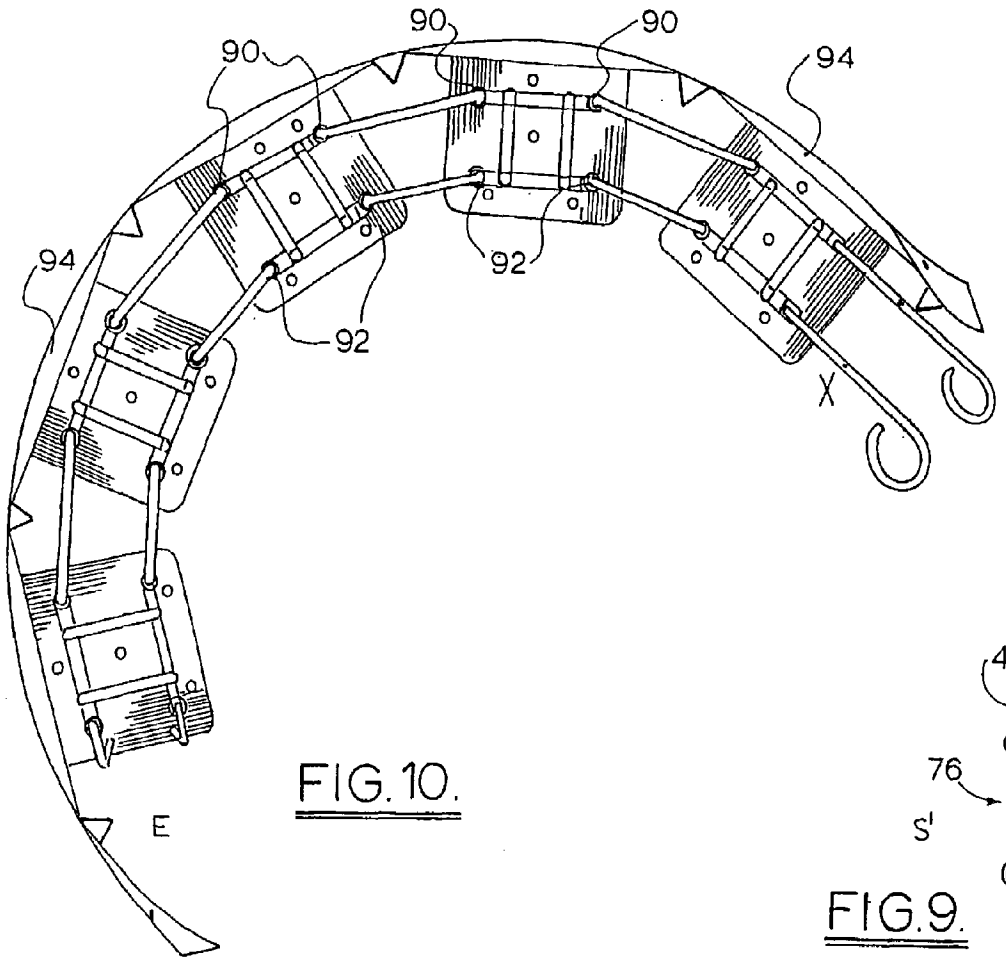
FIGS. 10 and 11 illustrate a complimentary pair of flexible tracks, comprising a lower track and an upper track, respectively, being flexibly positioned and rigidly locked in corresponding non-straight configurations with locking means comprising pairs of parallel wires and a pair of flexible straps.
Figure 11:
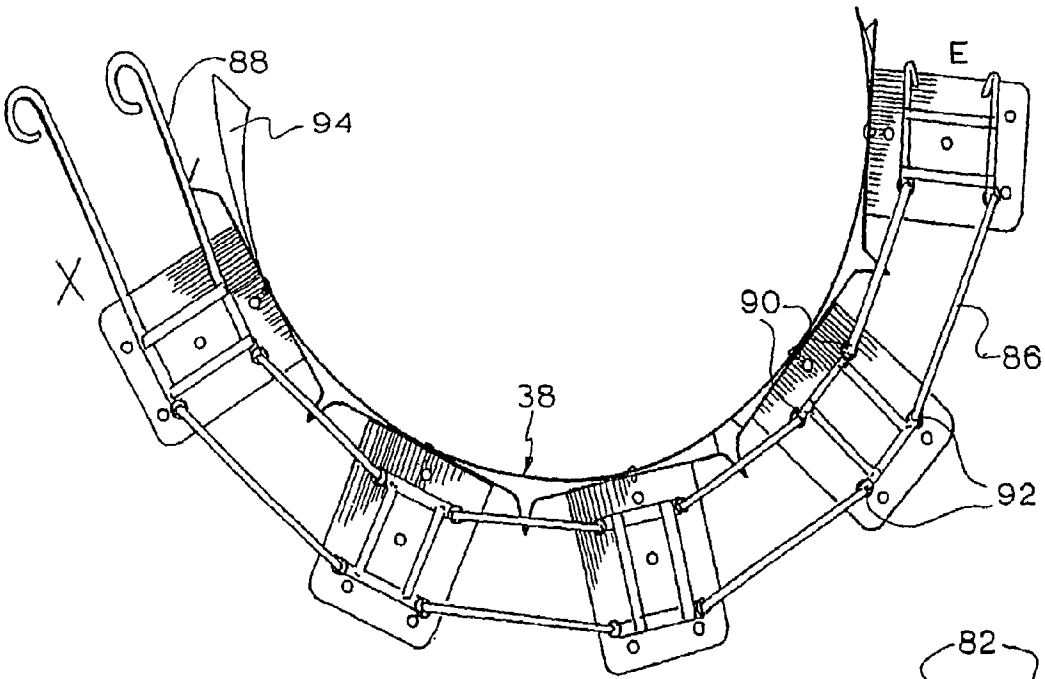

The flexible track 34 is shown in FIG. 4 in its initial condition having a straight configuration. The flexible track 34 can be used in its straight configuration in constructing a building element. Alternatively, the flexible track 34 is selectively flexibly positionable as a whole from the straight configuration to a non-straight configuration having a curvature not confined to a single plane. FIGS. 5 and 8 illustrate a flexible track 34 having a horizontal curvature whereas FIGS. 10 and 11 illustrated a flexible track 34 having a vertical curvature (compound curvature, whilst a feature of the invention is not illustrated).

Figure 7:
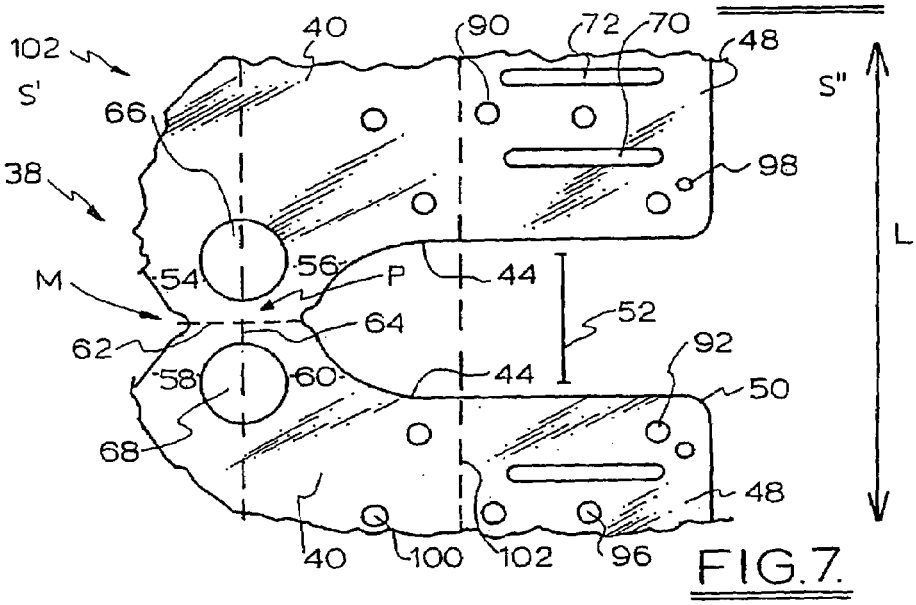
FIG. 7 is an enlarged partial plan view of a blank for use in forming a track according to a preferred embodiment of the invention, the blank defining part of a linking means and a pair of adjacent stud receiving components prior to the fold formation of the track shown in FIG. 4.

Each stud receiving component 36 of the flexible track 34 is generally formed with a horizontal base wall 40 having a longitudinal edge 42 and a transverse edge 44, a side wall 46 on a first side S' of the track 34 and a side wall 48 on a second side S" of the track 34, the side walls 46 and 48 extending vertically from respective longitudinal edges 42 of the base wall 40 and having rounded edges 50 (as best shown in FIG. 7) to prevent injury in use. The side walls 46, 48 form upright channels or brackets of sufficient height and width which together with the base wall 40 define a space in which a standard stud can be securely mounted.

Each linking means 38 of the flexible track 34 joins adjacent transverse edges 44 of the base walls 40 of an adjacent pair of stud receiving components 36, the linking means defining a gap including a longitudinal space 52 between adjacent side walls 46 or 48 and between corners of adjacent base walls 40 as illustrated in FIGS. 4 and 5. As further illustrated in FIGS. 6 to 8, the linking means 38, which is in the form of a narrow deformable bridge, includes a medial section M defining a pivot means P comprising a pivot point(s) or axes about which the linking means 38 is adjustable. The pivot means P comprises a set of four downwardly extending pivot members 54, 56, 58 and 60, in the form of narrow legs, which branch from the medial section M of the linking means 38 in symmetrical arrangement about a medial transverse fold line 62 and an imaginary medial longitudinal line 64 to a respective proximal first side S' (in the case of each of pivot members 54 and 58) or second side S" (in the case of each of pivot members 56 and 60) of the respective adjacent base wall 40. The linking means 38 includes perforations 66 and 68 on opposite sides of the bridge formed by the medial transverse fold line 62 to enhance the flexibility of the linking means. The pair of transversely medial perforations 66 and 68 are disposed along the imaginary medial longitudinal line 64 in longitudinally offset opposed relation about the medial transverse fold line.

The stud receiving components 36 of each adjacent pair of stud receiving components are selectively flexibly angled and positioned relatively to one another by the pivotal adjustment of the linking means 38 about the pivot means P, the linking means 38 being adjustable about the pivot means P to provide horizontal, vertical or compound track curvature. In particular, the linking means 38 can be adjusted by flexing, squeezing or stretching the linking means 38 at/about the pivot means P, which allows for movement in a number of directions. The gaps including longitudinal spacings 52, which are provided as calculated out-cuts, between adjacent stud receiving components 36 facilitate the adjustment of the linking means 38, since each spacing 52 is adapted to widen or narrow according to the adjustment (e.g. flexing, squeezing, stretching), and direction thereof, of the linking means 38 and provides sufficient space, as an opening or closing space, to prevent obstruction of the stud during stud insertion and retention. A comparison of the longitudinal spacings 52 illustrated in FIGS. 4 and 5 shows that the spacing widens (compared with the regular spacing in the initial condition) on the external radius side (see 52' in FIG. 5) of a curve and narrows on the internal radius side (see 52" in FIG. 5) of the curve.

The track 24 is selectively lockable for use of the track in construction either in a straight configuration (e.g. in initial condition) or, following flexible positioning, in a non-straight configuration, to maintain a relative angle and positioning of the stud receiving components 36 to one another.

For this purpose, the track 34 is configured with at least one locking means passage on each side, S' and S", of the longitudinal track axis L for using locking means to lock the track 34 in a non-straight configuration having horizontal, vertical or compound curvature. Each locking means passage is defined by a plurality of longitudinally spaced apart vertically aligned locking means apertures forming a guideway and a plurality of longitudinally spaced apart fixing points so that a inextensible locking means, having a separate body, can extend in longitudinal spanning slidable arrangement through the guideway to be securable to the track 34 at each of the plurality of fixing points so as to maintain the track 34 in a rigid (or at least stiffened or tensioned) and locked (or at least stabilised) configuration. The locking means passage on the first side S' of the track 34 is defined by at least one locking means aperture or at least one pair of longitudinally or vertically spaced apart locking means apertures disposed on a side wall 46 of each stud receiving component 36, whilst the locking means passage on the second side S" of the track 34 is defined by at least one locking means aperture or at least one pair of longitudinally or vertically spaced apart locking means apertures disposed on a side wall 48 of each stud receiving component 36. The plurality of fixing points should include a fixing point at least at the fixing means passage entrance E, exit X and at one or more points longitudinally intermediate the entrance E and exit X. For locking in a non-straight configuration having vertical or compound curvature, the track 34 requires at least a pair of vertically spaced apart parallel locking means passages extending along each side of the track so that the track in be manipulated in multiple directions and the fixing point may include a locking means catch at which the locking means can be locked.

As clearly shown in FIGS. 4, 5, 7 and 8, a first form of locking means apertures comprises a pair of longitudinally spaced apart vertically extending aperture slots 70 and 72 cut out of each side wall 46 and 48 of a stud receiving component 36 so that a locking means, shown in FIGS. 5 and 8 to comprise an inextensible flexible material strap 74, can be inserted in one and out the other of the slots, 70 and 72 respectively, to extend along the track 34 through one or more additional such first form of locking means apertures in the illustrated slidable longitudinal spanning arrangement.

Figure 6:
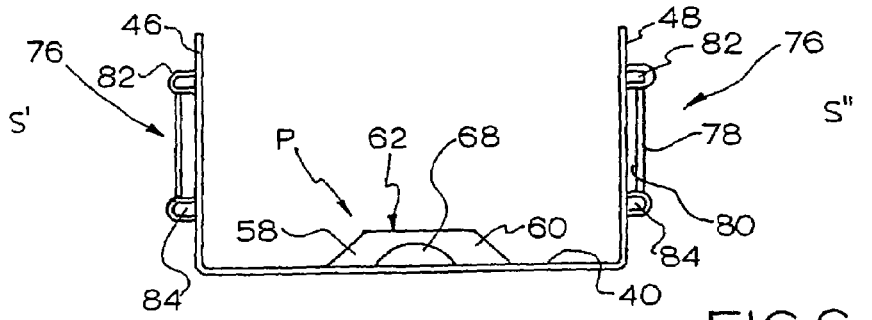
FIG. 6 is an enlarged transverse cross-sectional view of a stud receiving component and a linking means of the flexible track according to a preferred embodiment of the invention.
Figure 9:
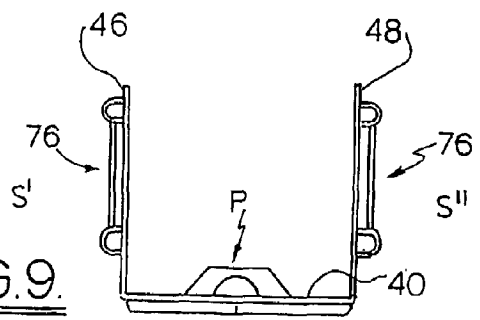
FIG. 9 is an enlarged transverse cross-sectional view of a stud receiving component and a linking means according to a further preferred embodiment of the invention for improved stud retention.
Figure 12:
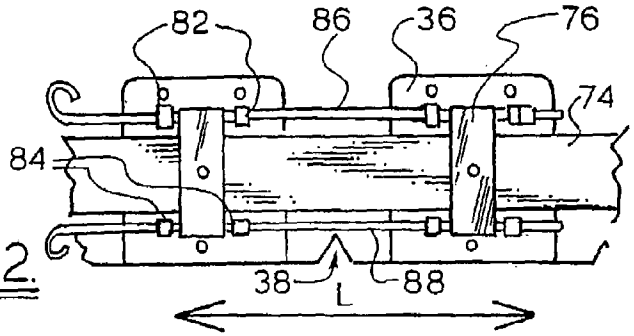
FIG. 12 is a partial side view of a track according to FIG. 10 or 11 in a straight configuration prior to rigid locking in the non-straight configuration.

As clearly shown in FIGS. 6, 9 and 12, a second form of locking means aperture comprises a vertically extending slot 76, being either an out-pressed section of each side wall 46 and 48 or formed on each side wall 46 and 48 of a stud receiving component 36 so that the vertical wall 78 of the slot 76 is horizontally spaced from its side wall 46 or 48 of the stud receiving component 36 so that a locking means, as shown in FIG. 12 to comprise an inextensible flexible material strap 74, can be inserted through the horizontal space 80 between the vertical wall 78 and the side wall 46 or 48 to extend along the track 34 through one or more additional such second form of locking means apertures in the illustrated slidable longitudinal spanning arrangement.

As clearly shown in FIGS. 6, 9 and 12, a third form of locking means aperture comprises a pair of vertically spaced apart loop holes 82 and 84, as shown in FIGS. 6, 9 and 12 (two longitudinally spaced apart pairs being shown), formed on each side wall 46 and 48 of a stud receiving component 36, so that a pair of locking means, as shown in 12 to comprise inextensible wires 86 and 88, can extend through the pair of loop holes 82 and 84, respectively, and one or more additional such third form of locking means apertures along the track 34 in the illustrated parallel slidable longitudinal spanning arrangement. The loop holes 82 and 84 may also function as locking means catches, with the wires being deformable to engage a selected catch(es) along the track and thereby lock the track in the non-straight configuration.

A shown in FIGS. 4, 5, 7, 8, 10 and 11, a fourth form of locking means aperture comprises a lower and an upper pilot hole, or as illustrated, a pair of longitudinally spaced apart lower and an upper pilot holes 90 and 92, respectively, formed in each side wall 46 and 48 of a stud receiving component 34, so that a locking means, shown in FIGS. 10 and 11 to comprise wires 86 and 88, can be inserted in one and out the other of the pilot holes of the lower and upper pilot holes or pairs of pilot holes, 90 and 92, respectively, and one or more additional such fourth form of locking means apertures in parallel slidable longitudinal spanning arrangement.

As illustrated, each stud receiving component 36 includes a number of different forms of locking means apertures (70, 72; 76; 82, 84; and/or 90, 92) to accommodate the use of the different forms of locking means (74; and/or 86, 88) for locking the track 34 in a non-straight configuration having a horizontal, vertical or compound curvature. For example, the vertically extending slot 76, shown in FIG. 6, or the pair of slots 70 and 72, shown in FIG. 8, is/are provided on each side wall 46 and 48 of the stud receiving components 36, above and below which slot(s) 76 or 70 and 72 are provided the pair of loop holes 82 and 84 and/or a lower and upper pair of longitudinally spaced pilot holes 90 and 92. The locking means and locking means passages can be used in combination as required. Optionally, additional locking means such as a strip of flat metal 94 (as shown in FIGS. 10 and 11) of any suitable length and width can be mounted along the longitudinal track axis for extra strength and/or to provide a smoother and/or more rounded surface to the track 34.

The preferred form of locking means for locking the track in a non-straight configuration having a horizontal curvature comprises an inextensible flexible material strap 74, or a flat strip of metal 94, being adapted for use particularly with the first and second forms of locking means apertures 70, 72 and 76, respectively. The preferred form of locking means for locking the track in a non-straight configuration having a vertical or compound curvature comprises an inextensible flexible wire (as shown in FIGS. 10 to 12) which is adapted for use particularly with the third and fourth forms of locking means apertures 82, 84 and 90, 92, respectively.

Once the or each locking means (74; 86, 88; and/or 94) has been positioned in longitudinal spanning arrangement along each side of the track 34, the locking means (74; 86, 88; and/or 94) can be fixed in position. In the case of the wire locking means 86, 88, the wire 86, 88 can be fixed by squeezing the wire 86, 88 into a suitable configuration, such as to block movement of the wire 86, 88, through the loop hole 82, 84 or pilot hole 90, 92, with a tool such as a set of pliers. Alternatively, the wire can be fixed by screwing, rivoting or spot welding the wire 86, 88, to the track 34. In the case of the flexible strap 74 locking means, fixing apertures in the form of pilot holes 96 are provided in the side walls 46 and 48 of the stud receiving components 36 so that the flexible strap 74 can be fixed by clamping or by the use of conventional fastening means such as screws, rivots or the like (not shown) inserted through the pilot holes 96. The locking means (74; 86, 88; and/or 94) may not necessarily require fixing at each stud receiving component 36 along the locking means passage, however, it may be necessary to fix the locking means at least at the locking means passage entrance E, exit X and at a fixing point (s) intermediate the entrance E and exit X.

As illustrated, additional fixing apertures, in the form of pilot holes 98 in the side walls 46, 48, can be fitted for fixing the stud to the track, by clamping or using fastening means, especially during installation or as previously described for fixing the locking means to the track. The fastening means used for fixing the studs to the track may be removed once a number of studs have been inserted. Additional fixing apertures, in the form of pilot holes 100 in the base walls 40, can be fitted for fixing the track to a structure, such as a floor or ceiling, by clamping or using fastening means.

The track 34 may be manufactured having integral stud receiving components 36 and linking means 38 by the cutting and folding of a blank 102 (as shown in FIG. 7) of suitable material, such as a piece of metal. The longitudinal track axis L of the track 34 can be manufactured in any suitable length and similarly the stud receiving components 36 and linking means 38 can have any suitable size and dimension. FIG. 7 illustrates the formation from a blank of material 102 of a linking means 38 joining a pair of adjacent stud receiving components 36. The gap including the longitudinal space 52 and perforations 66, 68 are formed by small generally v-shaped nicks/out-cuts and circular shaped calculated out-cuts, respectively, whereas the transverse medial fold line 62 is formed by folding to form a small bending upwards along line 62. The base wall 40 and side walls 46, 48 are defined by folding along line 102. The slot 76 and loop hole 82, 84 locking means apertures are either out-pressed or formed on side walls 46, 48, the pair of slots 70, 72 are formed as rectangular cut-outs in the side walls 46, 48, and the pair of pilot holes 90, 92 (plus fixing aperture pilot holes) are formed as circular cut outs in the side walls 46, 48 and/or base wall 40. The flexible track 34 embodiment illustrated is adapted to be positioned in a curved including circular non-straight configuration having a diameter as small as 300mm or as large as required.

Whilst the above has been given by way of illustrative example of the present invention many variations and modifications thereto will be apparent to those skilled in the art without departing from the broad ambit and scope of the invention as herein set forth in the appended claims, for example: the configuration of the stud receiving components can be modified to suit studs having distinct stud ends; the number, size, configuration and arrangement of locking means apertures and fixing apertures can be modified according to end user requirements; and the size and configuration of the longitudinal spacing and the perforations of the linking means can similarly be adjusted.

The invention claimed is:

1. A flexible track for use in constructing a building element, said track comprising:

a plurality of stud receiving components connected end-to-end, each stud receiving component having opposed transverse edges and being configured with a space adapted to receive an end portion of an elongate stud;

flexible linking means connecting facing ones of said transverse edges of adjacent stud receiving components; and locking means;

each said stud receiving component including a horizontal base wall having said opposed transverse edges and further including opposed longitudinal edges and a side wall extending vertically from each longitudinal edge of said base wall;

each said linking means joining said facing transverse edges of the base walls of adjacent stud receiving components;

said linking means defining a gap between respective side walls and between corners of respective base walls of adjacent stud receiving components on opposite sides of said track;

said gap being adapted to widen or narrow to flexibly position the track about said linking means;

said flexible linking means enabling a section of the track comprising multiple components to be manually manipulated as a whole section from a straight configuration to a non-straight configuration;

wherein said section of the track is thereafter lockable in said non-straight configuration by the locking means, and wherein said flexible linking means comprises a narrow deformable bridge joining the facing transverse edges of adjacent stud receiving components and having perforations on opposite sides of the bridge to enhance the flexibility of the linking means.

2. The flexible track according to claim 1, wherein:

said linking means includes pivot means about which said linking means is adjustable;

adjacent stud receiving components being selectively flexibly angled and positioned relatively to one another by pivotal movement at said linking means about said pivot means;

said linking means allowing the track to pivot to provide a track configuration not confined to a single plane.

3. The flexible track according to claim 1, the linking means comprising a set of four downwardly extending pivot members, said set branching from a medial section of said linking means in symmetrical arrangement about a medial transverse fold line and an imaginary medial longitudinal line to a respective proximal first or second side of the adjacent base wall, there being formed a pair of transversely medial perforations disposed along said imaginary medial longitudinal line in longitudinally offset opposed relation about said medial transverse fold line.

4. A flexible track for use in constructing a building element, said track comprising:

a plurality of stud receiving components connected end-to-end, each stud receiving component being adapted to receive an end portion of an elongate stud;

flexible linking means connecting adjacent stud receiving components; and locking means, said flexible linking means enabling a section of the track comprising multiple components to be manually manipulated as a whole section from a straight configuration to a non-straight configuration, wherein said section of the track is thereafter lockable in said non-straight configuration by the locking means, wherein:

said track includes at least one locking means passage on each of a first and a second side of a longitudinal track axis;

said locking means passage being defined by a plurality of longitudinally spaced apart locking means apertures and a plurality of longitudinally spaced apart fixing points;

there being a separate locking means for each said locking means passage, said locking means being adapted to extend in longitudinal spanning arrangement through the plurality of locking means apertures and be securable to said track at each of said plurality of fixing points to maintain said track in said locked configuration.

5. The flexible track according to claim 4:

each of said stud receiving components including a horizontal base wall having opposed transverse edges and opposed longitudinal edges and a side wall extending vertically from each longitudinal side edge of said base wall;

there being a locking means passage on the first side of said longitudinal axis defined by at least one locking means aperture disposed on the side wall on the first side of each said stud receiving component;

there being a locking means passage on the second side of said longitudinal axis defined by at least one locking means aperture disposed on the side wall of the second side of each said stud receiving component;

there being a fixing point at least at an entrance, an exit and a point intermediate said entrance and exit for said locking means along each said locking means passage;

each said locking means comprising a flexible strap;

wherein said flexible straps are adapted to maintain said track in a rigid configuration including a curvature in the horizontal plane when each said flexible strap is fixably secured in said locking means passage at each of said fixing points.

6. The flexible track according to claim 4:

each of said stud receiving components including a horizontal base wall having opposed transverse edges and opposed longitudinal edges and a side wall extending vertically from each longitudinal side edge of said base wall;

there being a pair of locking means passages on the first side of said longitudinal axis, said pair including a lower and an upper locking means passage disposed in relatively parallel vertically spaced apart relation, each of said lower and upper locking means passages being defined by a pair of longitudinally spaced apart locking means apertures disposed on the side wall of the first side of each said stud receiving component;

there being a pair of locking means passages on the second side of said longitudinal axis, said pair including a lower and an upper locking means passage disposed in relatively parallel vertically spaced apart relation, each of said lower and upper locking means passages being defined by a pair of longitudinally spaced apart locking means apertures disposed on the side wall of the second side of each said stud receiving component;

there being a fixing point at least at an entrance, an exit and a point intermediate said entrance and exit for said locking means along each said locking means passage;

each said locking means comprising a wire;

wherein said wires are adapted to maintain said track in a rigid configuration including a curvature in the vertical plane or a compound curvature when each said wire is fixably secured in said locking means passage at each of said fixing points.

7. A flexible track for use in constructing a building element, said track comprising:

a plurality of stud receiving components connected end-to-end, each stud receiving component being adapted to receive an end portion of an elongate stud;

flexible linking means connecting adjacent stud receiving components; and locking means, said flexible linking means enabling a section of the track comprising multiple components to be manually manipulated as a whole section from a straight configuration to a non-straight configuration, wherein said section of the track is thereafter lockable in said non-straight configuration by the locking means, wherein:

said stud receiving components include at least one guideway for said locking means; and said locking means comprises inextensible flexible material being slidable in the guideway as the track is manually moved into the non-straight configuration and securable to one or more stud receiving components to lock the track in the non-straight configuration.

8. A flexible track for use in constructing a building element, said track comprising:

a plurality of stud receiving components connected end-to-end, each stud receiving component having opposed transverse edges and being configured with a space adapted to receive an end portion of an elongate stud;

flexible linking means connecting facing ones of said transverse edges of adjacent stud receiving components; and locking means;

each said stud receiving component including a horizontal base wall having said opposed transverse edges and further including opposed longitudinal edges and a side wall extending vertically from each longitudinal edge of said base wall;

each said linking means joining said facing transverse edges of the base walls of adjacent stud receiving components;

said linking means defining a gap between respective side walls and between corners of respective base walls of adjacent stud receiving components on opposite sides of said track;

said gap being adapted to widen or narrow to flexibly position the track about said linking means;

said flexible linking means enabling a section of the track comprising multiple components to be manually manipulated as a whole section from a straight configuration to a non-straight configuration;

wherein said section of the track is thereafter lockable in said non-straight configuration by the locking means, said stud receiving components include at least one guideway for said locking means;

said locking means comprises inextensible flexible material being slidable in the guideway as the track is manually moved into the non-straight configuration and securable to the stud receiving components to lock the track in the non-straight configuration; and the stud receiving components include one or more locking means catches adjacent the guideway, the inextensible flexible material being deformable to engage a selected catch(es) along the track and thereby lock the track in the non-straight configuration.

9. A flexible track according to claim 8, wherein the linking means comprises a deformable narrow bridge between adjacent stud receiving components.

10. A flexible track according to claim 8, wherein the linking means comprises a narrow deformable bridge joining said facing transverse edges of adjacent stud receiving components and perforations on opposite sides of the bridge to enhance the flexibility of the linking means.

* * * * *